US007414491B2

(12) United States Patent
Higgins

(10) Patent No.: US 7,414,491 B2
(45) Date of Patent: Aug. 19, 2008

(54) METHOD AND APPARATUS FOR CHANGING THE POLARIZATION OF A SIGNAL

(75) Inventor: J. Aiden Higgins, Westlake Village, CA (US)

(73) Assignee: Teledyne Licensing, LLC, Thounsand Oaks, CA (US)

( * ) Notice: Subject to any disclaimer, the term of this patent is extended or adjusted under 35 U.S.C. 154(b) by 0 days.

(21) Appl. No.: 11/773,930

(22) Filed: Jul. 5, 2007

(65) Prior Publication Data

US 2007/0257745 A1 Nov. 8, 2007

Related U.S. Application Data

(63) Continuation of application No. 11/090,599, filed on Mar. 24, 2005, now abandoned.

(60) Provisional application No. 60/614,243, filed on Sep. 28, 2004.

(51) Int. Cl.
*H01P 1/18* (2006.01)
*H01P 1/165* (2006.01)

(52) U.S. Cl. ..... 333/12; 333/21 A; 333/157; 333/248

(58) Field of Classification Search ..... 333/12, 333/21 A, 156, 157, 239, 248
See application file for complete search history.

(56) References Cited

U.S. PATENT DOCUMENTS 3,721,923 A * 3/1973 Grey et al. ..... 333/157
4,263,570 A * 4/1981 De Fonzo et al. ..... 333/157
4,266,203 A 5/1981 Saudreau et al.
4,271,534 A 6/1981 Takayama
4,348,773 A 9/1982 Caroli
5,032,805 A * 7/1991 Elmer et al. ..... 333/156
5,099,214 A * 3/1992 Rosen et al. ..... 333/157
6,603,357 B1 8/2003 Higgins et al.
6,756,866 B1 6/2004 Higgins
6,919,862 B2 * 7/2005 Hacker et al. ..... 343/909

OTHER PUBLICATIONS

Higgins J.A. et al., "Ka-Band Waveguide Phase Shifter Using Tunable Electromagnetic Crystal Sidewalls", *IEEE Transactions On Microwave Theory and Techniques*, vol. 51, No. 4 (Apr. 2003).

Hollung, S. et al. "Bi-Directional Quasi-Optical Lens Amplifier", *IEEE MTT-S*, pp. 675-678 (Jun. 1997).

(Continued)

*Primary Examiner*—Robert J. Pascal
*Assistant Examiner*—Kimberly E Glenn
(74) *Attorney, Agent, or Firm*—Koppel, Patrick, Heybl & Dawson

(57) ABSTRACT

A method and apparatus for changing the polarization of an input signal includes propagating a polarized input signal having orthogonal E-field components by at least one surface each having a respective surface impedance and varying at least one of the surface impedances to shift the phase of one of the components independently from the other so that the polarity of said input signal is changed. Bi-directional propagation is achieved by rotating polarity in one direction but not the other.

19 Claims, 5 Drawing Sheets

OTHER PUBLICATIONS

Michael P. DeLisio et al., "A Ka-Band Grid Amplifier Module with Over 10 Watts Output Power", *IEEE MTT-S Digest*, pp. 83-86, (2004).

Hao Xin, et al., "Electromagnetic Crystal (EMXT) Waveguide Band-Stop Filter", *IEEE Microwave and Wireless Components Letters*, vol. 13, No. 3, pp. 108-110 (Mar. 2003).

J.A. Higgins, et al., "Characteristics of Ka Band Waveguide using Electromagnetic Crystal Sidewalls", *IEEE MTT-S Digest*, pp. 1071-1074 (2002).

U.S. Appl. No. 11/090,599, Notice of Allowance, mailed Jul. 6, 2007,

U.S. Appl. No. 11/090,599, Non-Final Office Action, Notice of References Cited by the Examiner (PTO-892), Reference cited by Applicant (PTO-1449), mailed Sep. 19, 2006.

* cited by examiner

FIG. 3
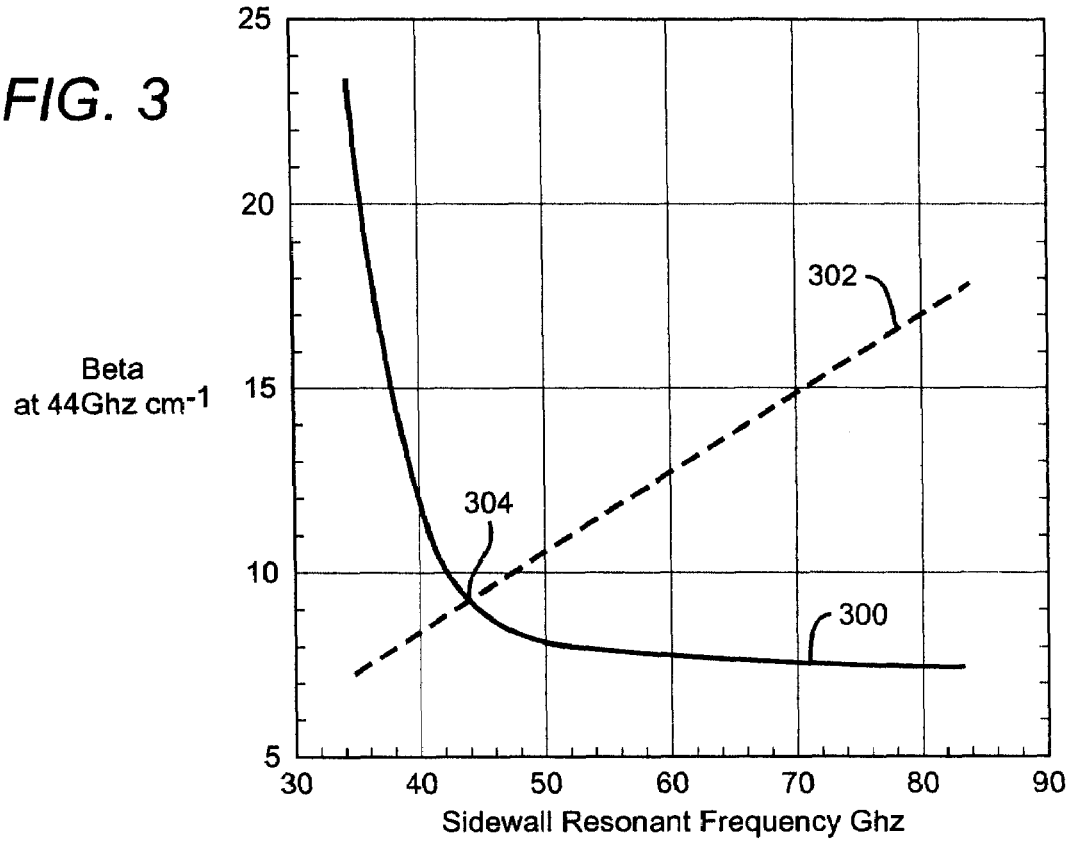
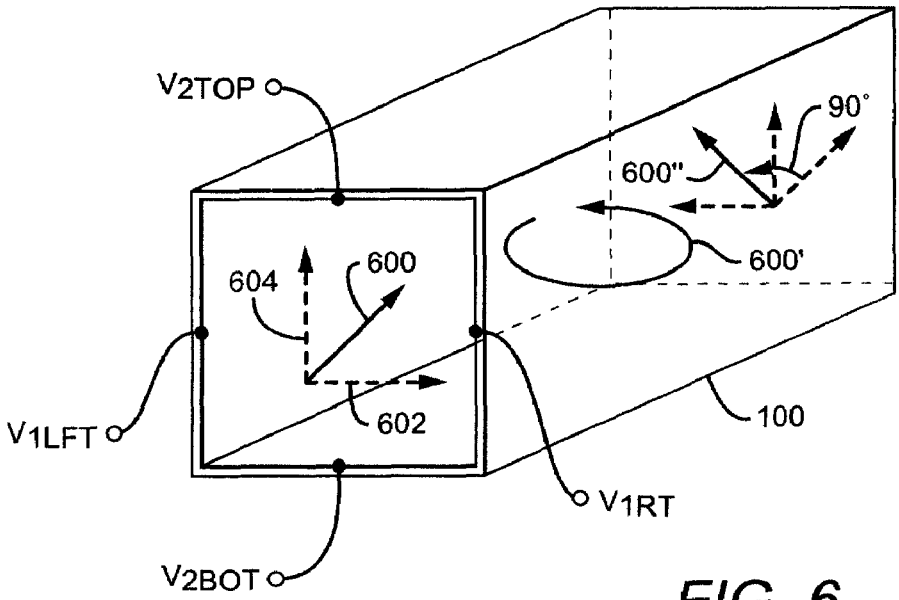
FIG. 6

METHOD AND APPARATUS FOR CHANGING THE POLARIZATION OF A SIGNAL

RELATED APPLICATION

This is a Continuation application claiming benefit of patent application Ser. No. 11/090,599, filed Mar. 24, 2005 now abandoned, and Provisional Application Ser. No. 60/614,243, filed Sep. 28, 2004.

BACKGROUND OF THE INVENTION

1. Field of the Invention

This invention relates to electronic systems, and more particularly to the transmission of electromagnetic signals.

2. Description of the Related Art

An electromagnetic wave propagating through space has orthogonal electric (E) and magnetic (H) field components commonly described in Cartesian coordinates. The concept of using an electromagnetic beam for transmitting information is attractive at high frequencies, such as the frequency band of approximately 20-40 GHz. Transmission of the electromagnetic beam to a destination typically involves the use of a signal-guiding element and one or more amplifiers in a power amplifier module. Functions such as switching and bi-directional amplification are used to accomplish the system.

In U.S. Pat. No. 6,756,866, J. Higgins describes a signal-guiding element in the form of a waveguide that has high impedance structures on its walls to provide phase shifting while maintaining power density across its width for amplification. The surface impedance of the walls is voltage controlled using voltage dependent capacitance which determines the resonant frequency of the wall impedance structure and results in a change of the wave propagation constant and, subsequently, the phase of transmission coefficients (S21 and S12). J. Higgins suggests the use of the impedance structure on all four walls of the waveguide to support simultaneous and active phase control of two linearly and orthogonally polarized microwave or millimeter wave signals. An array amplifier is an array of small amplifiers each with an input antenna and an orthogonally oriented (with respect to the input antenna) output antenna. The amplified wave is polarized orthogonally with respect to the input wave. The combination of such a waveguide and an array amplifier can establish a directional power amplifier module for guiding and amplifying the input signal.

One problem associated with the prior art power modules described above is the unidirectionality of their associated amplifier arrays. Amplifier arrays use input and output antennas that are perpendicular to one another and, because antennas radiate in both upstream and downstream directions, require polarizers to set the direction of gainful propagation. The orientation of the antennas in comparison to the polarization of the return signal prevents bidirectional signal gain for rotationally fixed power modules. If bidirectional signal gain is required, a second power module is typically used. This results in duplicative power modules.

SUMMARY OF THE INVENTION

A method and structure are provided that can be used for bi-directional amplification without duplicative power modules, or for other applications that benefit from controllably varying the polarization of a signal such as an RF switch. A polarized input signal having orthogonal E-field components is propagated by a waveguide surface whose impedance is varied to shift the phase of one of the E field components independently from the other, thus changing the composite signal's polarity.

In one embodiment, at least two pairs of opposing impedance-wall structures guide the signal, with different voltages applied to the walls of their respective pair to vary the wall impedance and, thereby, the propagation constant.

A bi-directional amplifier system that uses the polarization-changing apparatus rotates the signal's polarization in one direction of propagation, but not a return signal sent in the opposite direction, to achieve bi-directionality.

These and other features and advantages of the invention will be apparent to those skilled in the art from the following detailed description of preferred embodiments, taken together with the accompanying drawings.

BRIEF DESCRIPTION OF THE DRAWINGS

The components in the figures are not necessarily to scale, emphasis instead being placed upon illustrating the principles of the invention. Like reference numerals designate corresponding parts throughout the different views.

FIG. 3 is a graph showing propagation constant versus surface impedance resonant frequency for a signal propagating through free space and through an impedance-wall waveguide.

FIG. 6 is a perspective view illustrating the rotation of a linearly polarized input signal through a ninety-degree rotation using an impedance-wall waveguide.

DETAILED DESCRIPTION OF THE INVENTION

The invention provides a method and system for changing the polarization of a high-frequency input signal. A linearly polarized signal having an E-field component is propagated a suitable transmission system in which one of the E-field's orthogonal vector components can be phase shifted with respect to the other to change the polarization of the signal. For example, one vector component can be phase shifted relative to the other to change the polarization of a polarized signal from linear to circular and then to linear at a 90 degree angle to the original polarization.

Several embodiments are described in the context of an impedance-wall waveguide used to match the polarization of an input E field to the input antenna of an amplifier array. Other applications also make use of the changeable polarization, including switching, phase shifting, and signal isolation.

Figure 1:
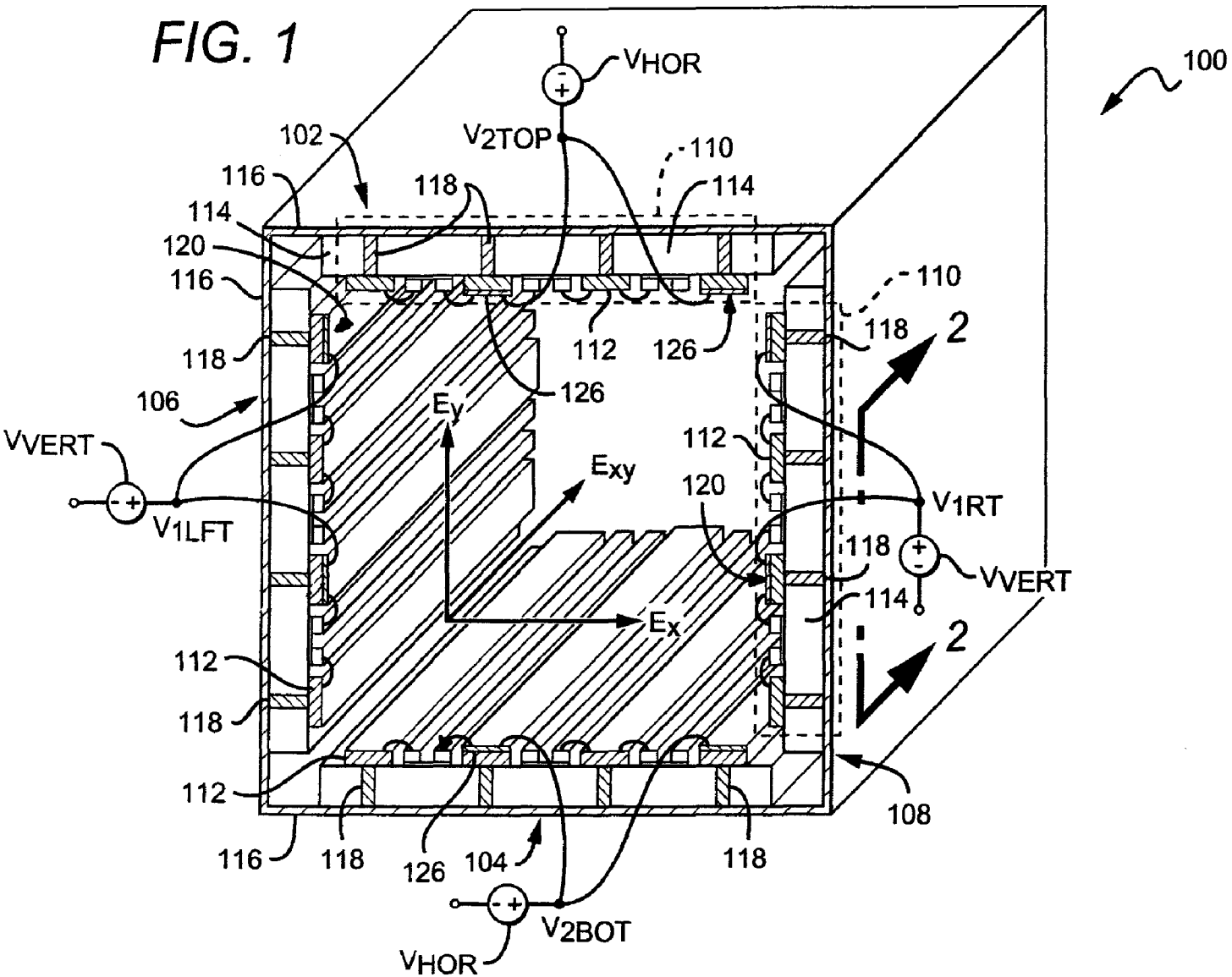
FIG. 1 is a perspective view illustrating an embodiment of an impedance-wall waveguide with independent impedance control of horizontal and vertical wall pairs.

FIG. 1 illustrates an implementation of an impedance-wall waveguide 100 having interior dimensions equivalent to a 30-35 GHz waveguide (7.11×7.1 mm±0.02) and a length of approximately 5 mm. The impedance-wall waveguide 100 has opposed 'horizontal' walls 102, 104 connected to a DC voltage source $V_{HOR}$ through terminals $V_{2TOP}/V_{2BOT}$, respectively, and opposed 'vertical' walls 106, 108 connected to a second DC voltage source $V_{VERT}$ through terminals $V_{1LFT}/V_{1RT}$, respectively. The two respective voltage sources can also be implemented as dual outputs from a common or singular source. The propagating signal is characterized as a Transverse Electric mode with E field component $E_{xy}$ composed of orthogonal x and y oriented component fields, with Ez equal to zero.

The waveguide walls are operated in respective opposed pairs to guide a polarized input signal along the waveguide's longitudinal direction $(z)_0$. Each wall has a high-impedance structure 110 to maintain a substantially uniform power density across the waveguide's width. A plurality of conductive strips 112 on each wall are arranged transverse to the input signal and facing the waveguide's interior to support the input signal's H field component through the waveguide 100. The conductive strips 112 are made of a conductive material, preferably gold, and are formed on a dielectric substrate 114 (such as, but not necessarily, Gallium Arsenide (GaAs)). Other suitable substrates include ceramic, plastic, polyvinyl carbonate (PVC) and high resistance semiconductor materials. A conductive exterior sheet 116 is electrically coupled to each conductive strip 112 by vias 118 extending through the substrate 114.

On the left and right walls 106, 108, vertical-vector control strips 120 alternate with the conductive strips 112 on the interior surface of the dielectric substrate 114, and are coupled to terminals $V_{1LFT}$ and $V_{1RT}$, respectively, to receive a control voltage. In the embodiment of FIG. 1, a linearly polarized input signal is illustrated as being introduced to the waveguide with its E field $E_{xy}$ oriented diagonally to the left/right and top/bottom walls of the waveguide. The control strips 120 are described herein as "vertical vector" control strips to highlight their effect on a vertical vector component $E_y$ of the diagonally oriented E field, rather than the physical orientation of the strips in the waveguide 100. As a voltage from terminals $V_{1LFT}$ and $V_{1RT}$ is applied to the vertical-vector control strips 120 on walls 106 and 108, a voltage differential is created across the gap between vertical-vector control and conductive strips 120, 112 that varies a pre-existing gap capacitance between the strips. The vertical vector component of the E-field, $E_y$, responds to the change in capacitance, as measured by a change in its propagation constant $\beta_{(y)}$, as it propagates through the waveguide 100. An increase in voltage at terminals $V_{1LFT}$ and $V_{1RT}$ reduces the gap capacitance, increases the resonant frequency of the left and right walls (106, 108) and reduces $\beta_{(y)}$. Similarly, a decrease in the voltage at terminals $V_{1LFT}$ and $V_{1RT}$ increases gap capacitance, reduces the resonant frequency of the left and right walls 106, 108 and increases $\beta_{(y)}$.

The top and bottom walls 102, 104 have a similar strip-impedance structure 110, with conductive strips 112 alternating with horizontal vector control strips 126. The horizontal vector control strips 126 are coupled to voltage terminals $V_{2TOP}$ and $V_{2BOT}$ to vary the pre-existing gap capacitance between successive strips 126, 112. A variation in the voltage communicated to the horizontal-vector controls strips 126 from terminals $V_{2TOP}$ and $V_{2BOT}$ operates to vary the propagation constant of the horizontal vector component of the E field $E_x$, the gap capacitance and the resonant frequency of the top and bottom walls 102, 104 in a manner similar to the side walls.

In operation, terminals $V_{1LFT}/V_{1RT}$ and $V_{2TOP}/V_{2BOT}$ enable independent voltage control of the left/right and top/bottom wall structure pairs 106/108 and 102/104, respectively, for independent phase control of the vertical and horizontal vector components, $E_y$ and $E_x$, respectively, of the input signal's $E_{xy}$ field component. When one vector component reaches 90 degrees out of phase with the other, the E field has changed from linear to circular polarization. As the relative phase difference between the two vector components approaches 180 degrees, the E field again becomes linearly polarized, but with an orientation that is 90 degrees rotated from the initial orientation.

Although the waveguide 100 is illustrated having a square cross-section, the waveguide may be constructed with wall structure pairs positioned in another polygonal cross-section such as a rectangle, hexagon or octagonal. Curved and opposing wall pairs may also be used.

Figure 2:
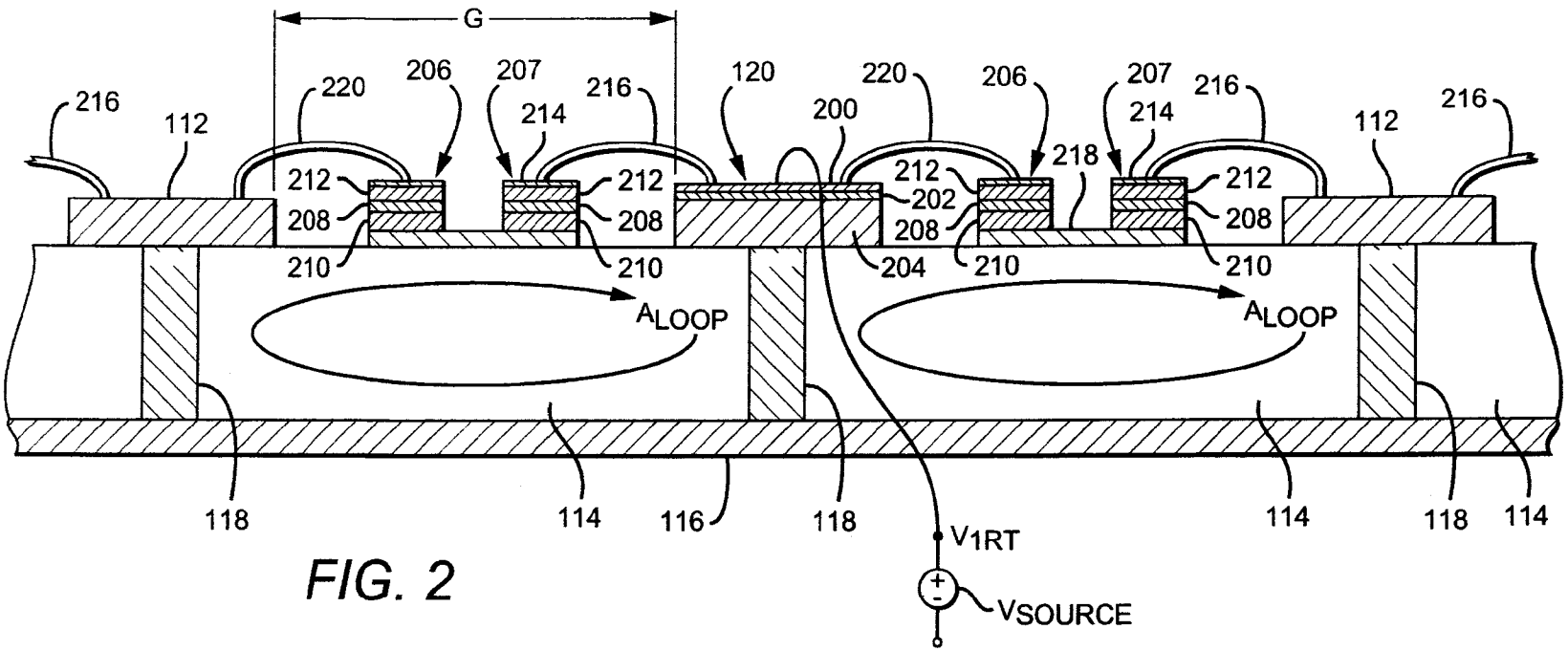
FIG. 2 is a sectional view of the impedance-wall waveguide of FIG. 1, taken along section lines 2-2.

FIG. 2 provides a more detailed sectional view of one embodiment of an impedance-wall structure that can be used to change the polarization of the input signal by changing the phase of one of its E field vector components. It depicts side wall 110, rotated 90 degrees for ease of view. In FIG. 2, each vertical vector control strip 120 is defined by a conductive voltage strip 200 that is insulated from via cap 202 and via 118 by an insulator strip 204. The gap between conductive and vertical vector control strips 112, 120 includes a pair of voltage-variable capacitors ("varactors") 206, 207 that operate to vary the capacitance across the gap as experienced by the E field of the input signal. The varactors 206, 207 are defined by a wide-band gap layer 208, preferably formed of Aluminum Gallium Arsenide (AlGaAs), sandwiched between N− anode and N− cathode layers 210, 212, preferably formed of Gallium Arsenide (GaAs), that allow depletion regions to form in each varactor 206, 207 upon application of a voltage bias across them. N+ ohmic contact layer 214 establishes an ohmic contact to couple an anode air bridge 216 with the N− anode layer 210. The varactors 206, 207 are coupled together through an N+ diode-connecting layer 218. A bias voltage from terminal $V_1$ is communicated through conductive voltage strip 200 and anode air bridge 216 to varactor 206. The N− cathode layer 212 of varactor 207 is coupled to conductive sheet 116 through via 118, conductive strip 112 and cathode air bridge 220. The varactors 206, 207 operate together to create a total capacitance that varies with the voltage across them. Air bridges 216, 220 are preferably formed of a metal such as gold, from vapor deposition on a photoresist which is subsequently removed to form the bridges 216, 220.

In the waveguide described above, terminals $V_{1LFT}/V_{1RT}$ and $V_{2TOP}/V_{2BOT}$ preferably receive bias voltages between approximately 1 and 10 Volts. The various other elements of this particular waveguide have the following approximate thicknesses and widths:

| | Thickness (microns) | Width (microns) |
|---|---|---|
| Conductive strips 112 | 5 | 1000-2000 |
| Insulating substrate 114 | 50-1000 | NA |
| Conductive voltage strip 200 | 2 | 1000-2000 |
| Via cap 202 | 1 | 1000-2000 |
| Insulator strip 204 | 0.2 | 1000-2000 |
| wide-band gap layer 208 | 0.01 | 4 |
| N− anode layer 210 | 0.2 | 4 |
| N− cathode layer 212 | 0.2 | 4 |
| N+ ohmic contact layer 214 | 0.1 | 4 |
| N+ diode connecting layer 218 | 5 | 10-15 |
| Gap G | NA | 50-100 |

In operation, a positive voltage applied to terminals $V_{1LFT}$ and $V_{1RT}$ is communicated to conductive voltage strip 200 to bias the varactors 206, 207. The bias results in a reduced total capacitance through a loop circuit $A_{LOOP}$ defined by the control strip 120, the varactors 206 and 207, the conductive strip 112, the exterior sheet 116 and back to the control strip 120. A reduced capacitance through the loop circuit $A_{LOOP}$ increases the resonant frequency of a current generated by an H field companion to the vertical vector component of the E field, resulting in increased resonant frequency and phase velocity (due to a reduced propagation constant β) for the vertical vector component of the E field. As the voltage at terminals $V_{1LFT}/V_{1RT}$ is reduced, the capacitance across the varactors 206, 207 increases, resulting in the gap capacitance increasing, and the left and right walls 106, 108 resonate at a lower frequency to reduce the phase velocity of the vertical vector component. The top and bottom wall pair is controlled in the same manner with the voltage at terminals $V_{2TOP}/V_{2BOT}$ to control the E field's horizontal vector component. With independent phase control of each vector component of the E field, the E field's polarization can be controlled by independently controlling the voltages at terminals $V_{1LFT}/V_{1RT}$ and $V_{2TOP}/V_{2BOT}$.

Curve 300 in FIG. 3 illustrates the relationship between propagation constant β and the sidewall resonant frequency of a waveguide designed to operate at approximately 44 GHz that has two resonant sidewalls 5 mm wide. Line 302 shows the propagation constant β as a function of frequency for a signal propagating in free space outside the waveguide. The intersection 304 of curve 300 and line 302 at 44 GHz illustrates the frequency at which a signal propagating through the waveguide propagates as if in free space. This means that when operating frequency is the same as sidewall resonant frequency (approximately 44 GHz), the waveguide mode is TEM. Reducing the wall pair's resonant frequency below 44 GHz increases the operating frequency (approximately 44 GHz) propagation constant β. For example, decreasing the voltage applied to the voltage strip 200 from terminals $V_{1LFT}/V_{1RT}$ increases the capacitance of each varactor diode 206, 207 to increase the gap capacitances. With increased gap capacitances, the wall pair resonates at a lower frequency, resulting in an increased propagation constant β for the E-field vector component parallel to the surface of the control strip 120, thus increasing the phase shift experienced by the vector component. In the same way, increased voltage leads to reduced phase shift.

Figure 4:
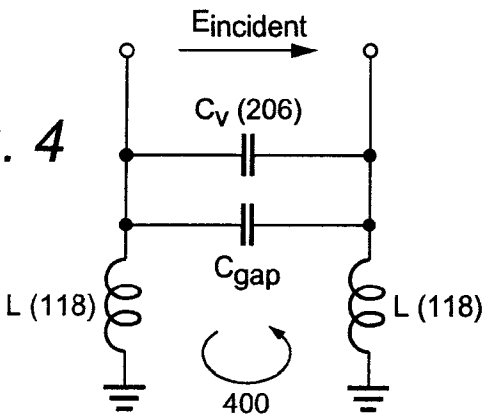
FIG. 4 is a schematic diagram of equivalent L-C circuits formed by the impedance-wall structure illustrated in FIG. 2.

The impedance-wall structure illustrated in FIG. 2 can be represented by parallel resonant L-C circuits as illustrated in FIG. 4. The incident signal is represented as an incident electric field parallel to the surface. At approximately the impedance-wall resonant frequency, the loop circuit $A_{LOOP}$ in FIG. 2 is represented as an inductive reactance in parallel with the capacitance on the surface due to varactor and gap capacitances Cv and Cgap. The varactors 206, 207 provide variable capacitances $C_v$ that vary the resonant frequency of the resultant parallel L-C circuit. For an incident wave at a frequency below that resonant frequency, the wall responds with an inductive impedance. When the incident wave frequency is the same as the resonant frequency, the wall responds with a very high surface impedance. For incident frequencies above resonant frequency, the wall responds with a capacitive impedance.

With impedance-wall structures on all four sides of the waveguide 100, the waveguide can be used to change the polarization of an input signal introduced to the waveguide with E field components in the x and y directions of FIG. 1. Each vector component of the E field is phase shifted to progressively change the polarized E field from, for example, linear to circular and then back to linear polarization, resulting in an E-field rotation of 90 degrees. Similarly, a circular polarized E field introduced to the waveguide can be phase shifted to change the polarized E field from circular to linear and then back to circular polarization.

Figure 5:
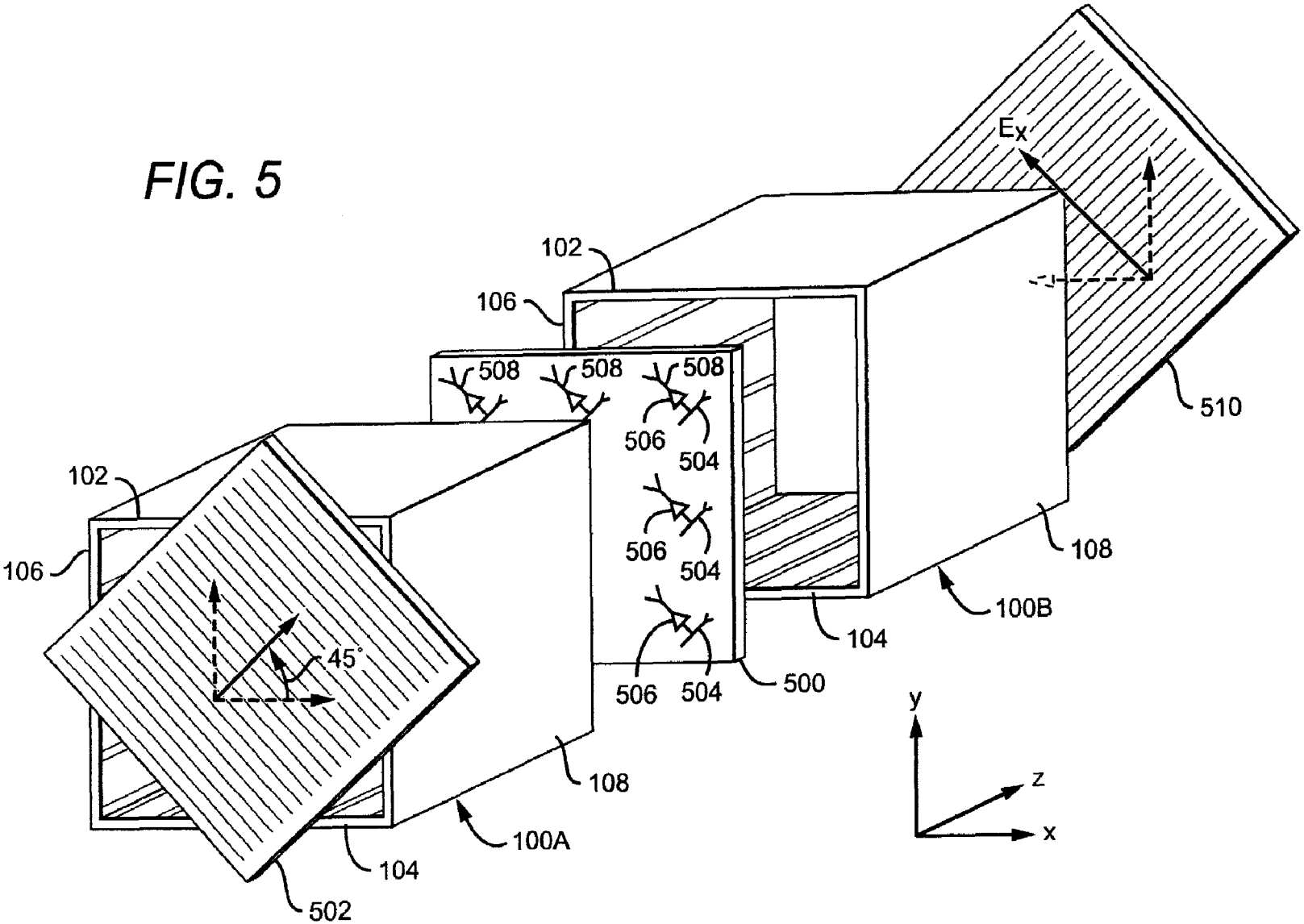
FIG. 5 is an exploded perspective view of one embodiment of a bi-directional amplifier module that uses impedance-wall waveguides to change the polarization of an input signal to align with an amplifier array.

The above embodiments are shown applied to a bi-directional power amplifier in FIG. 5. A Cartesian coordinate system having X and Y-axes defined by horizontal and vertical waveguide walls 102/104, 106/108, respectively, is chosen for convenience of discussion. An array amplifier 500 is aligned between two impedance-wall waveguides 100A and 100B to amplify a linearly polarized input signal to define a power amplifier module 501. Forward input signal with its linearly polarized E field component $E_S$ oriented diagonally (+45 degrees from the X-axis) is presented to a polarizer 502 also angled +45 degrees from the X-axis. The 45° polarizer 502 allows the diagonally oriented E field component $E_S$ to pass into the waveguide 100A. Because $E_S$ is oriented +45 degrees, its horizontal and vertical vector components are equal in magnitude as presented to the vertical and horizontal walls of the waveguide 100A. With no voltages applied to the walls of the waveguide, the E field component $E_S$ passes through the waveguide 100A without a differential phase shift of its horizontal and vertical vector components, and is presented to input antennas 504 on each of the amplifiers 506 of the array amplifier 500, with each input antenna 504 oriented parallel to $E_S$. For the embodiment illustrated in FIG. 5, the array amplifier 500 has amplifiers 506 spaced 0.6 mm apart with each amplifier 506 having an output antenna 508 perpendicular to its input antenna 504. The E field component $E_S$ is accordingly amplified and radiated out of each output antenna 508 in an orientation that is perpendicular to its original orientation. Although the amplified forward input signal is radiated in both the forward and reverse directions, it is prevented from radiating in the reverse direction by the 45° polarizer 502. The amplified E field component $E_S$ propagates through the second waveguide 100B without change to its polarity orientation, and proceeds through a polarizer 510 that is rotated −45 degrees from the X axis.

Typically, a system outputting a signal oriented in one direction would receive a similarly oriented linearly polarized return signal in the reverse direction with an E field component $E_R$ for amplification. In the illustrated embodiment, $E_R$ passes through the −45° polarizer 510 and bias voltages are applied to the impedance-wall waveguide 100B so that it rotates the $E_R$ polarization by 90 degrees into alignment with the input antennas 504. $E_R$ is accordingly amplified by the amplifiers 506 and radiated by output antennas 508. Because the output antennas 508 are perpendicular to the input antennas, the polarization of amplified $E_R$ is rotated 90 degrees for propagation through the waveguide 100A. Waveguide 100A is also operated in an active mode, with bias voltages applied to its impedance walls to rotate the polarization of amplified $E_R$ by 90 degrees, allowing it to pass through the 45° polarizer 502. The directions "forward" and "reverse" are presented for convenience of discussion and may be interchanged. For example, an input signal initially presented to waveguide 100B for polarization rotation may be labeled as a forward input signal.

FIG. 6 illustrates the progressive change in E field polarization experienced by a signal as it propagates through a waveguide 100 as described above. The application of a voltage differential between terminals $V_{1LFT}/V_{1RT}$ and $V_{2TOP}/V_{2BOT}$ results in the horizontal vector component 602 of an input signal E field 600 experiencing a different propagation constant β than the E field's vertical vector component 604 as it propagates through the waveguide 100. When the phase difference between the vector components equals 90 degrees, the E field 600' has been changed from a linear to a circular polarization. Continued phase differentiation by another 90 degrees results in the E field 600" returning to a linear polarization, but 90° from its original orientation.

Figure 7:
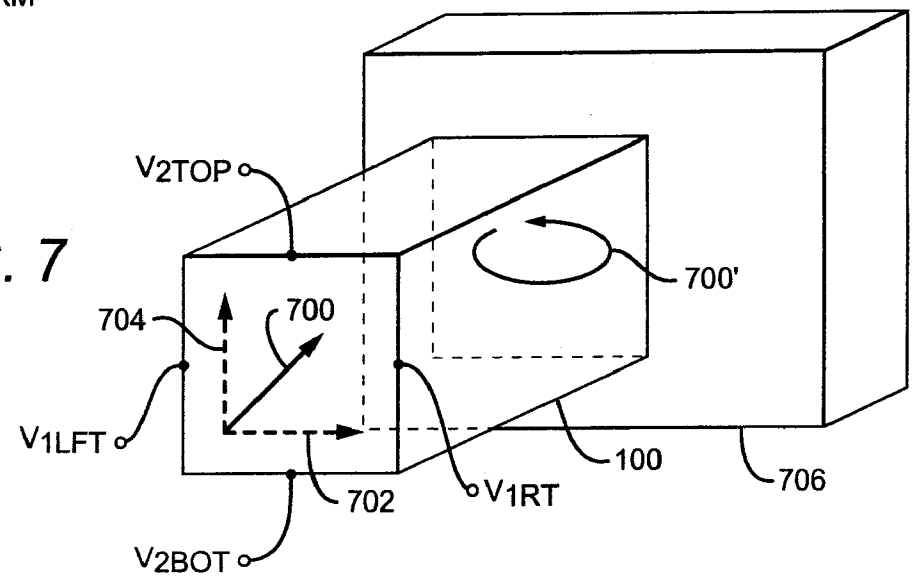
FIG. 7 is a perspective view illustrating a switch consisting of ferrite material and the impedance-wall waveguide illustrated in FIG. 1.

As illustrated in FIG. 7, the impedance-wall waveguide of FIG. 1 may be used in combination with a microwave ferrite material to establish a radio-frequency switch (an "RF switch"). A linearly polarized input signal is introduced to the waveguide 100, preferably with its E field oriented diagonally to the left/right and top/bottom walls of the waveguide 100. To turn the switch "off," a voltage differential is applied between terminals $V_{1LFT}/V_{1RT}$ and $V_{2TOP}/V_{2BOT}$ resulting in a phase difference between the horizontal and vertical vector components 702, 704 of the E field. The voltage differentials are applied so that the transformation of the E field from linear to circular polarization is accomplished as the circularly polarized E field 700' is introduced to the ferrite material 706. The ferrite material 706 is positioned and biased by a DC magnetic field so that the direction of rotation of the circularly polarized E field 700' is the same as to the ferrite material's electron precession direction in order to absorb the signal. For the example of attenuation or signal absorption, if application of a voltage differential between terminals $V_{1LFT}/V_{1RT}$ and $V_{2TOP}/V_{2BOT}$ results in a predetermined clockwise E field rotation, the ferrite material would be positioned with its electron precession direction also oriented clockwise to absorb the signal (attenuate the signal). To turn the switch "on" (i.e. to allow the signal to pass through with substantially no attenuation, the voltage at terminals $V_{1LFT}/V_{1RT}$ and $V_{2TOP}/V_{2BOT}$ is adjusted so that the E field is circularly polarized in the counterclockwise direction.

Figure 8:
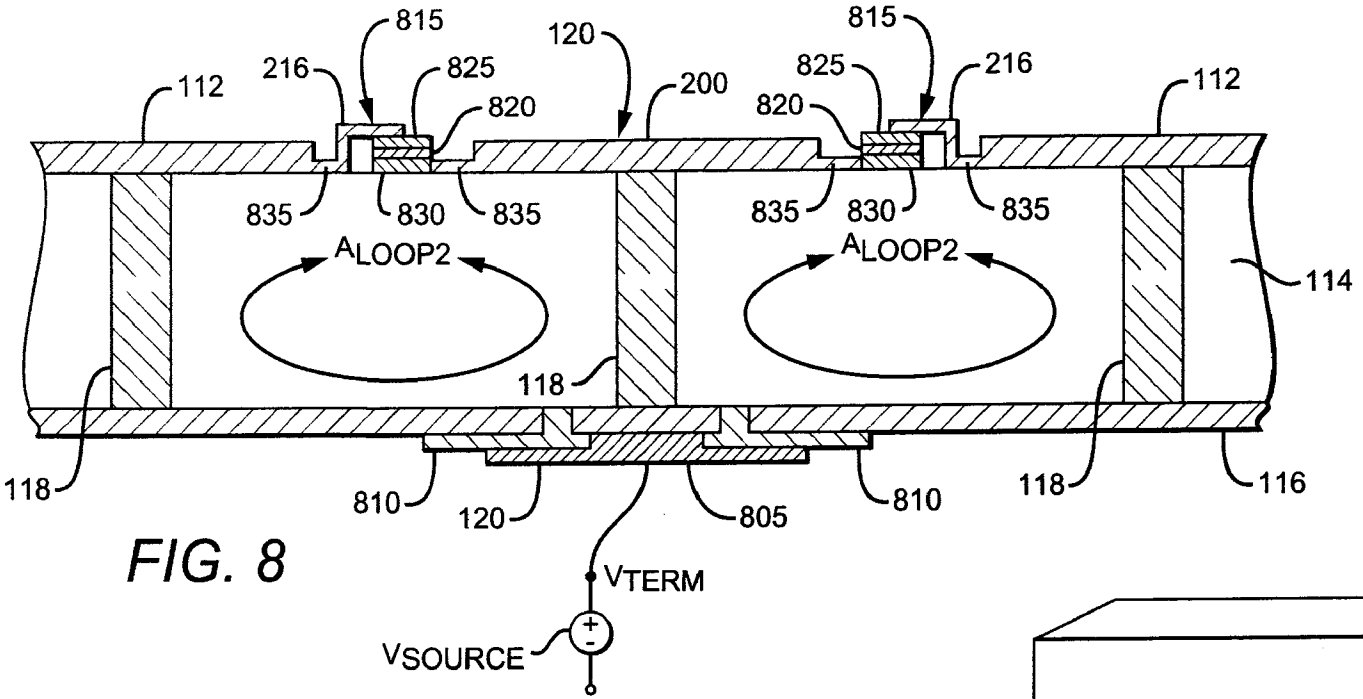
FIG. 8 is a sectional view of an alternative embodiment of an impedance-wall for use with an impedance-wall waveguide.

FIG. 8 illustrates an alternative embodiment for the left/right and top/bottom wall structure pairs 106/108 and 102/104, respectively, illustrated in FIG. 1. In FIG. 8, each vertical vector control strip 120 is defined by a conductive voltage strip 200 coupled to $V_{Source}$ at terminal $V_{TERM}$ through the via 118 and a voltage contact strip 805. The conductive voltage strip 200 is insulated from the conductive exterior sheet 116 by insulator strip 810. Each gap between conductive and vertical vector control strips 112, 120 includes a GaAs Schottky diode 815 that operates to vary the capacitance across the gap as experienced by the E field of the input signal. The diodes 815 are defined by an N− capacitor layer 820 sandwiched between a metal barrier anode 825 and N+ cathode 830. Each barrier anode 825 is coupled to adjacent respective conductive strips 112 through the anode air bridge 216. During operation, a voltage bias from terminal $V_{TERM}$ is communicated to N+ cathode 830 through conductive voltage strip 200 and a cathode contact 835. Depletion regions form across each diode 815 in response to the bias voltage across them that operate to vary the capacitance across the gap as experienced by the E field of the input signal. The bias results in a reduced total capacitance through a loop circuit $A_{LOOP2}$ defined by the control strip 120, the diode 815, the conductive strip 112, the exterior sheet 116 and back to the control strip 120.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

What is claimed is:

1. A method comprising:

propagating a polarized forward input signal having orthogonal E-field components by at least one surface each having a surface impedance; and varying at least one of said surface impedances to shift the phase of one of said orthogonal E-field components independently from the other, thereby changing the polarity of said forward input signal.

2. The method of claim 1, further comprising:

amplifying at least a portion of said forward input signal to form a forward output signal.

3. The method of claim 2, further comprising:

transmitting said forward output signal with an antenna so that the polarization of said forward output signal is rotated 90 degrees from said forward input signal.

4. The method of claim 3, wherein a residue portion of said forward input signal is propagated without amplification or polarization rotation, further comprising:

filtering said residue portion of said forward input signal downstream from the transmission of said output signal.

5. The method of claim 1, further comprising:

amplifying said forward input signal to form a forward output signal;

transmitting said forward output signal with an antenna so that the polarization of said forward output signal is rotated 90 degrees from said forward input signal;

propagating said forward output signal by at least one second surface having respective second surface impedances; and varying at least one of said second surface impedance to shift the phase of one orthogonal E-field component of said forward output signal independently from another orthogonal E-field component of said forward output signal to rotate the polarity of said forward output signal to match the orientation of said input antenna.

6. The method of claim 5, further comprising:

propagating a polarized reverse input signal having orthogonal E-field components, by said at least one second surface.

7. The method of claim 6, further comprising:

amplifying said reverse input signal to form a reverse output signal.

8. The method of claim 7, further comprising:

transmitting said reverse output signal with said antenna so that the polarization of said reverse output signal is rotated 90 degrees from said reverse input signal.

9. The method of claim 6, wherein a residue portion of said reverse input signal is propagated without amplification or polarization rotation, further comprising:

filtering said residue portion of said reverse input signal downstream from the transmission of said reverse output signal.

10. The method of claim 1, wherein the polarity of said forward input signal is shifted to circular for at least a part of the propagation of said forward input signal.

11. The method of claim 10, further comprising:

selectively blocking said forward input signal with a ferrite material while said forward input signal circularly polarized to switch further propagation of said forward input signal.

12. An apparatus for changing the polarization of an input signal, comprising:

at least two pairs of opposing impedance-wall structures for guiding said signal; and a respective voltage source connected to each of said at least two pairs of said impedance-wall structures, each said respective voltage source independently operable to vary the wall impedances of their respective at least two pairs.

13. The apparatus of claim 12, wherein said pairs of impedance-wall structures comprise a first impedance-wall waveguide.

14. The system of claim 13, further comprising:

a second impedance-walled waveguide comprising at least two pairs of opposing impedance-wall structures, each pair of structures coupled to a respective voltage source to independently vary respective wall impedances, said array amplifier positioned between said first and second waveguides.

15. The system of claim 14, further comprising:

an output polarized filter positioned on the opposite side of said second waveguide from said first waveguide, to filter a portion of said input signal whose polarization has not been rotated.

16. The apparatus of claim 12, wherein each of said impedance-wall structures comprises a voltage-variable capacitor to receive a voltage from said respective voltage source.

17. The apparatus of claim 12, further comprising:

an array amplifier positioned to amplify said input signal after the polarization of said input signal has been rotated.

18. The system of claim 17, wherein said array amplifier comprises a plurality of amplifiers, each of said amplifiers having input and output antennas oriented perpendicular to each other.

19. A bi-directional amplification method, comprising:

propagating a polarized forward input signal having orthogonal E-field components to an input antenna by at least one surface having respective first surface impedances;

amplifying said forward input signal to form an output signal;

transmitting said output signal with an output antenna so that the polarization of said output signal is rotated 90 degrees from said forward input signal;

propagating said output signal by at least one second surface having respective second surface impedances;

propagating a reverse input signal having orthogonal E-field components to said input antenna in the reverse direction to said forward input signal;

varying at least one of said second surface impedances to shift the phase of one orthogonal E-field component of said reverse input signal independently from another orthogonal E-field component of said reverse input signal to rotate the polarity of said reverse input signal to match the orientation of said input antenna;

amplifying said reverse input signal to form an output reverse signal;

transmitting said reverse output signal with said output antenna so that the polarization of said output reverse signal is rotated 90 degrees from said reverse input signal; and varying at least some of said first surface impedances to shift the phase of one orthogonal E-field component of said output reverse signal, thereby changing the polarity of said output reverse signal.

* * * * *

UNITED STATES PATENT AND TRADEMARK OFFICE

CERTIFICATE OF CORRECTION

PATENT NO. : 7,414,491 B2
APPLICATION NO. : 11/773930
DATED : August 19, 2008
INVENTOR(S) : J. Aiden Higgins It is certified that error appears in the above-identified patent and that said Letters Patent is hereby corrected as shown below:

Claim 12 - on line 4 insert the word --input-- between the words “said” and “signal”.

Signed and Sealed this

Tenth Day of February, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,414,491 B2
APPLICATION NO. : 11/773930
DATED : August 19, 2008
INVENTOR(S) : J. Aiden Higgins It is certified that error appears in the above-identified patent and that said Letters Patent is hereby corrected as shown below:

Column 8, Claim 12 - on line 65 insert the word --input-- between the words “said” and “signal”.

This certificate supersedes the Certificate of Correction issued February 10, 2009.

Signed and Sealed this

Tenth Day of March, 2009

John Doll

JOHN DOLL
*Acting Director of the United States Patent and Trademark Office*